US006263835B1

(12) United States Patent
Santi

(10) Patent No.: US 6,263,835 B1
(45) Date of Patent: Jul. 24, 2001

(54) APPARATUS FOR TRAINING HORSES

(76) Inventor: Luigino Santi, Via Giara, 8, 37031 Illasi (IT)

( * ) Notice: Subject to any disclaimer, the term of this patent is extended or adjusted under 35 U.S.C. 154(b) by 0 days.

(21) Appl. No.: 09/445,836

(22) PCT Filed: Jun. 18, 1998

(86) PCT No.: PCT/IT98/00165

§ 371 Date: Dec. 13, 1999

§ 102(e) Date: Dec. 13, 1999

(87) PCT Pub. No.: WO98/57720

PCT Pub. Date: Dec. 23, 1998

(30) Foreign Application Priority Data

Jun. 18, 1997 (IT) ..... VR97A0054

(51) Int. Cl.[7] ..... A63K 3/04
(52) U.S. Cl. ..... 119/705
(58) Field of Search ..... 119/702, 705; 482/15, 16, 41, 17, 38; 256/60, 64, 65, 67; 248/219.1, 219.2, 219.3, 218.4, 205.1, 200.1

(56) References Cited

U.S. PATENT DOCUMENTS 5,679,105 * 10/1997 Vittone et al. ..... 482/93
5,842,954 * 12/1998 Slupskiy ..... 482/15
5,967,093 * 10/1999 Vitt et al. ..... 119/705

FOREIGN PATENT DOCUMENTS 2712820 6/1995 (FR) .
93/24197 12/1993 (WO) .

* cited by examiner

*Primary Examiner*—Thomas Price
(74) *Attorney, Agent, or Firm*—Daniel O'Byrne

(57) ABSTRACT

An apparatus for training horses having a series of adjustable obstacles with transverse crosspieces, the apparatus comprising a base structure formed by a pair of substantially horizontal and parallel guide rails disposed on the ground at a predetermined distance from each other, a plurality of vertical mounts slideably placed upon the guide rails to adjust their longitudinal position therealong. The vertical mounts have vertically mobile supports for supporting and holding the crosspieces at adjustable height. The same number of vertical mounts is disposed on both rails in mutually facing relationship to form pairs, each vertical mount being fixed on a wheeled carriage coupled to a first motor to provide synchronous movement of the pairs along the guide rail. A second motor acts on the vertically mobile support to adjust their vertical position along the guide rail.

4 Claims, 13 Drawing Sheets

APPARATUS FOR TRAINING HORSES

TECHNICAL FIELD

The present invention relates to an apparatus for training horses of the type comprising a series of adjustable obstacles including transverse crosspieces to be jumped over by the horses to be trained.

BACKGROUND ART

As it is known, in the field of horse training and more precisely in the specialised schools assigned to this purpose, there are utilised some apparatuses which, together with appropriate measures or methods, allow to impose or to increase the ability of the horses, or to correct defects of the imposition, by means of specific exercises.

One of the methods used provides for the predisposition on the training field of a series of low crosspieces or obstacles, displaced consecutively on appropriate trestles positioned at a certain distance one from the other, adapted to impose the stride or to correct any imposition defects in the stride, or to increase the ability of the horse forcing it to carry out preimposed gymnastic exercises.

The low crosspieces or obstacles for the stride training of the horses, which up to now have been devised, force the trainers into a notable manual activity for the positioning and above all to the variation of the inter-distance and of the height of the obstacles themselves, according to operations which must be carried out by positioning or in any event moving each of the obstacles singularly.

All of this renders the work of the operators predisposed to the training of the horses rather heavy and laborious, which work turns out to be even more onerous if it is considered that in a horse school there may be trained numerous horses, each with different training and corrective necessities.

Moreover, the above cited trestles may represent a real danger for the horses, due to the presence of protruding parts which may injure or in any event represent stumbling elements, as it may also happen that the horse, knocking against the obstacles placed on the trestles, may vary the inter-distance or the configuration thereof.

A system for vertical regulation of equestrian obstacles with distance actuation is disclosed in document FR-A-2712820, whereby no presence of operators is necessary.

In this system the obstacles can be placed in series, too. However the presence of operators near the obstacles is required when the latter must be displaced in the longitudinal direction so as to change distance between obstacle.

DISCLOSURE OF THE INVENTION

One principle object of the present invention is to eliminate or at least reduce the above mentioned drawbacks, by providing an apparatus for the training of horses which allows an automatic adjustment of the obstacles both longitudinally and vertically, in a manner to allow both the variation of the inter-distance between one obstacle and another, and the variation of the single heights.

A further object of the present invention is to provide a training apparatus of the specified type, which allows to automatically and quickly change the configuration of the obstacles in a manner to perform particular exercises both in training and in competitions.

These and other objects which will appear more clearly hereinafter are achieved by an apparatus for training horses, comprising a series of adjustable obstacles including transverse crosspieces to be jumped over by the horses to be trained, a plurality of vertical elements or mounts having vertically mobile supports for supporting and holding the crosspieces of said obstacle at adjustable height, characterised by the fact of comprising a base structure formed by a pair of substantially horizontal and parallel guide rails disposed on the ground at a predetermined distance from each other, the vertical elements or mounts being slidably placed upon said guide rails to adjust their longitudinal position therealong.

The same number of vertical mounts is disposed on both rails in mutually facing relationship with respect to each other to form pairs of mounts placed along orthogonal directions with respect to the axes of the rails.

Each of said vertical mounts is fixed on a wheeled carriage adapted to slide along said guide rails. Each of said carriages comprises first motor means adapted to provide synchronous horizontal movement of each pair of mounts along said rails, said first motor means comprising a pinion meshing with a rack fixed along one edge of each rail or a similar driving mechanism.

Each of said vertically mobile supports is mounted on a slider adapted to slide along a vertical guide attached to a respective vertical mount, each slider being operatively coupled to a second motor means to promote vertical movement thereof along said vertical guide, said second motor means being of the type including a worm screw or a similar mechanism.

Said first and said second motor means are coupled to a central control device which may be operated by a command panel or by a remote control unit.

Each rail is provided with a tubular cover adapted to protect the rail against water, mud and other atmospheric agents and to protect the horses against injury from sharp edges of the rails.

Each vertical mount is attached to a respective carriage by means of a rotating joint and is held in a vertical position by means of a releasable stop means.

The first motor means provided on each carriage are disengageable from a respective rack to allow free sliding thereof along the respective rail.

The immediate advantage provided by the present invention consists in the elimination of the manual imposition of each single obstacle or crosspiece on the part of the trainer, whose work, utilising the apparatus according to the invention, will be limited to the adjustment both of the inter-distance and the height of the single obstacles or crosspieces, by simply operating a distance telecommand or intervening on a command board opportunely predisposed in the vicinity of the apparatus itself.

BRIEF DESCRIPTION OF DRAWINGS

Further characteristics and advantages of the present invention will become apparent from the following description of some preferred but not exclusive embodiments of a horse training apparatus according to the invention, illustrated by way of non-limiting examples with the help of the attached drawings in which.

BEST MODES FOR CARRYING OUT THE INVENTION

With reference to the enclosed Figures, with 1 there is indicated in its entirety an apparatus according to the present invention for the training of horses, which is substantially constituted by a pair of horizontal rails 2 and 2', mutually facing and disposed parallely between themselves. In the illustrated example the rails 2 and 2' have a substantially upside down "U" cross-section, even if they may have any other more appropriate cross-section. Along the rails 2 and 2' there are disposed many mobile vertical elements or mounts 3 and 3', which are positioned according to an equal number and disposition between one rail and the other, in a manner to form pairs which reciprocatingly face one another along orthogonal directions with respect to the axes of the rails.

Each of said mobile vertical elements or mounts, constituted by two facing columns indicated with A and B, are hooked on the rails 2 and 2' by means of a holding and rotation unit 4, or carriage.

Figure 1:
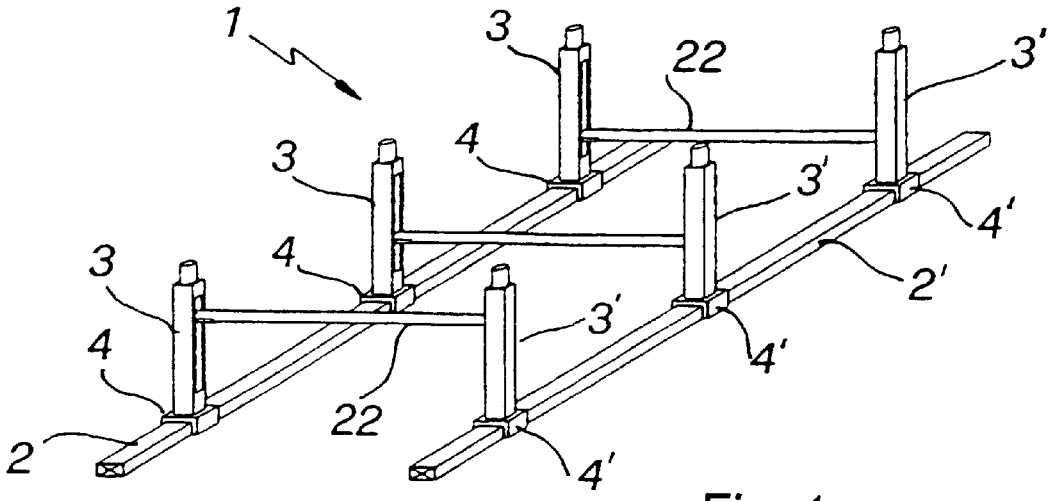
FIG. 1 is a general elevation view of a first embodiment of the apparatus according to the invention.
Figure 2:
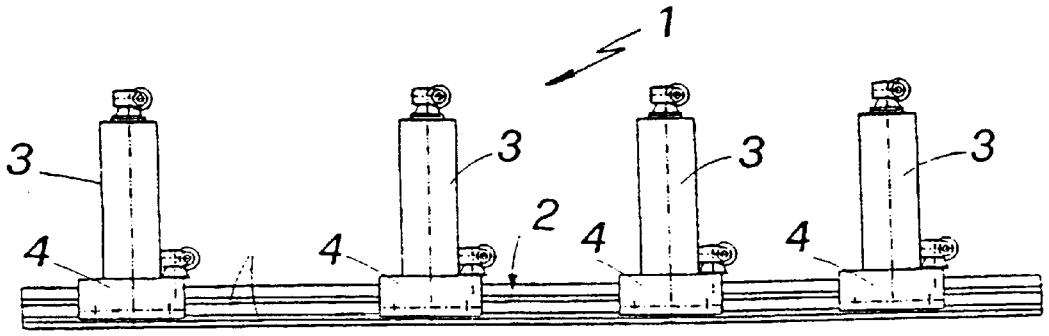
FIG. 2 is a schematic lateral view of the apparatus of FIG. 1.
Figure 3:
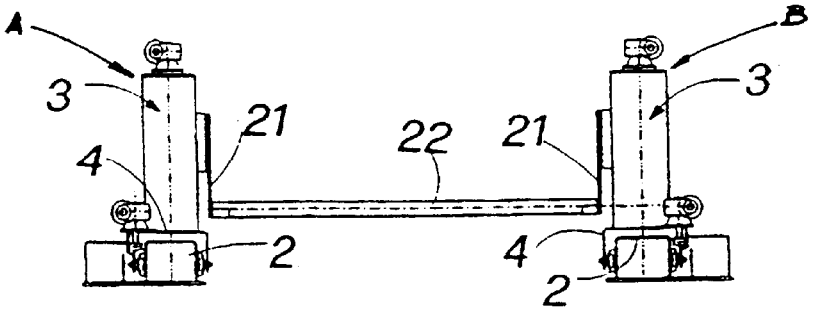
FIG. 3 is a schematic frontal view of the apparatus of FIG. 1.
Figure 4:
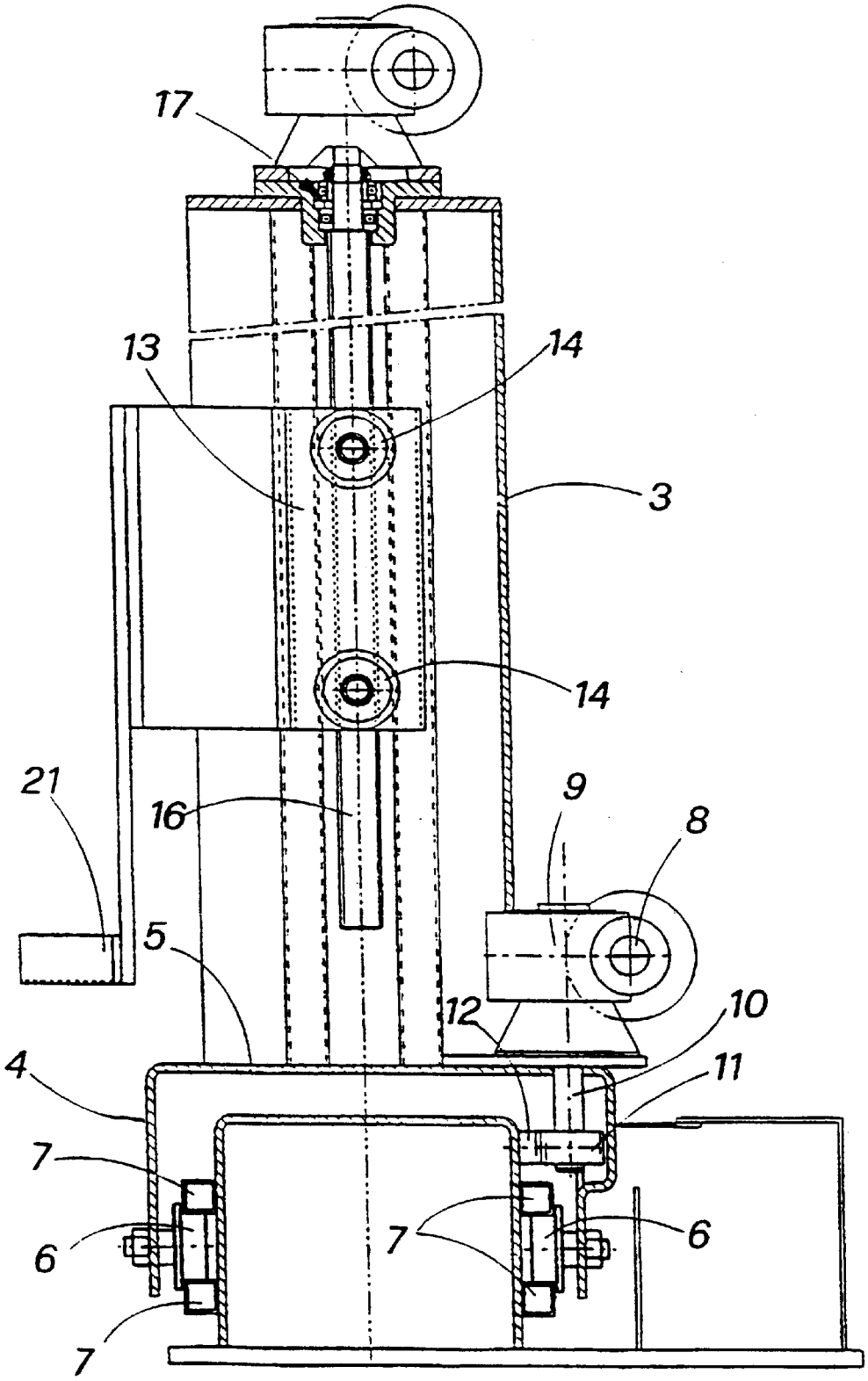
FIG. 4 is schematic frontal view of a detail of the apparatus of FIG. 3 in enlarged scale.
Figure 5:
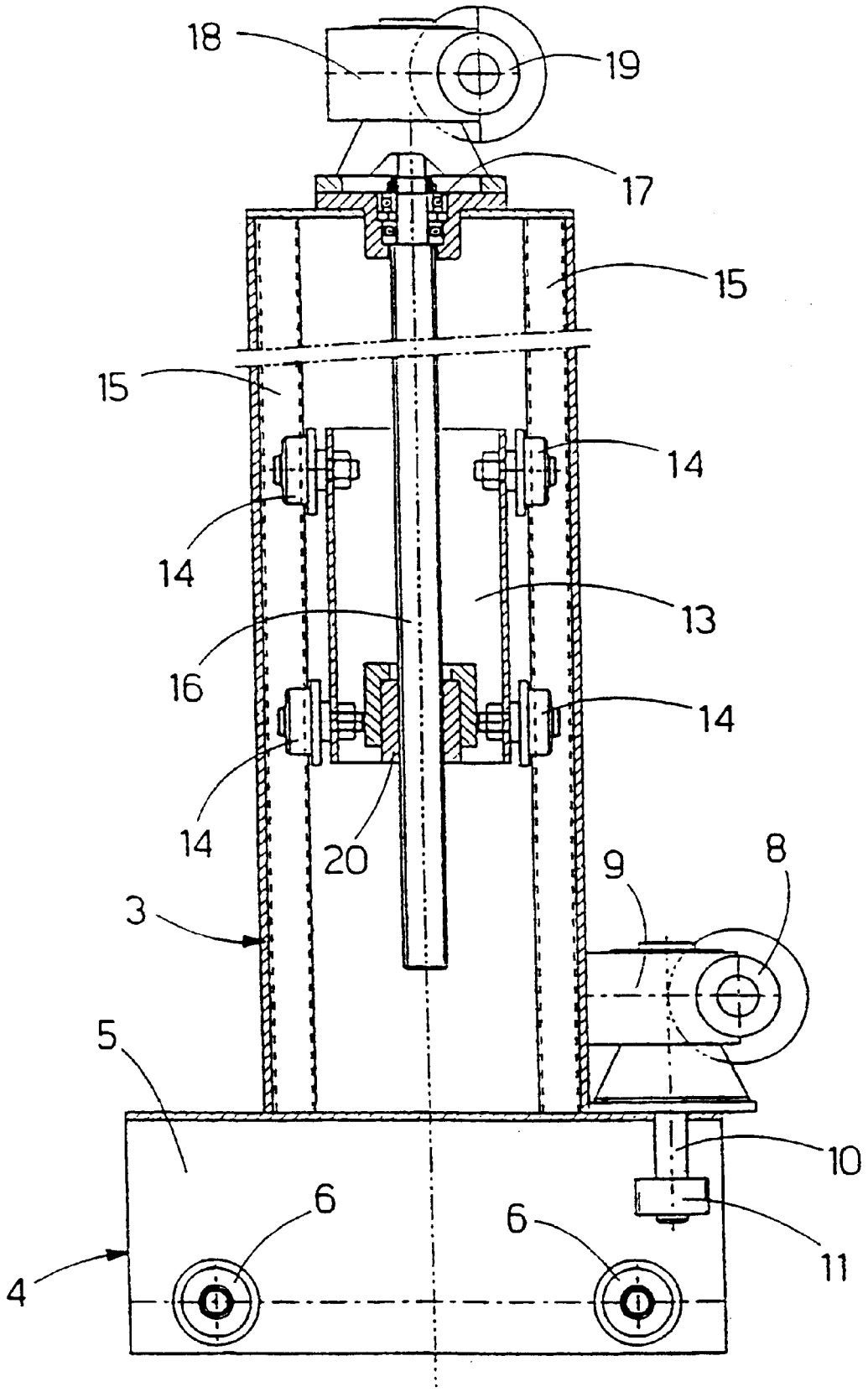
FIG. 5 is a schematic lateral view of the apparatus of FIG. 4.
Figure 6:
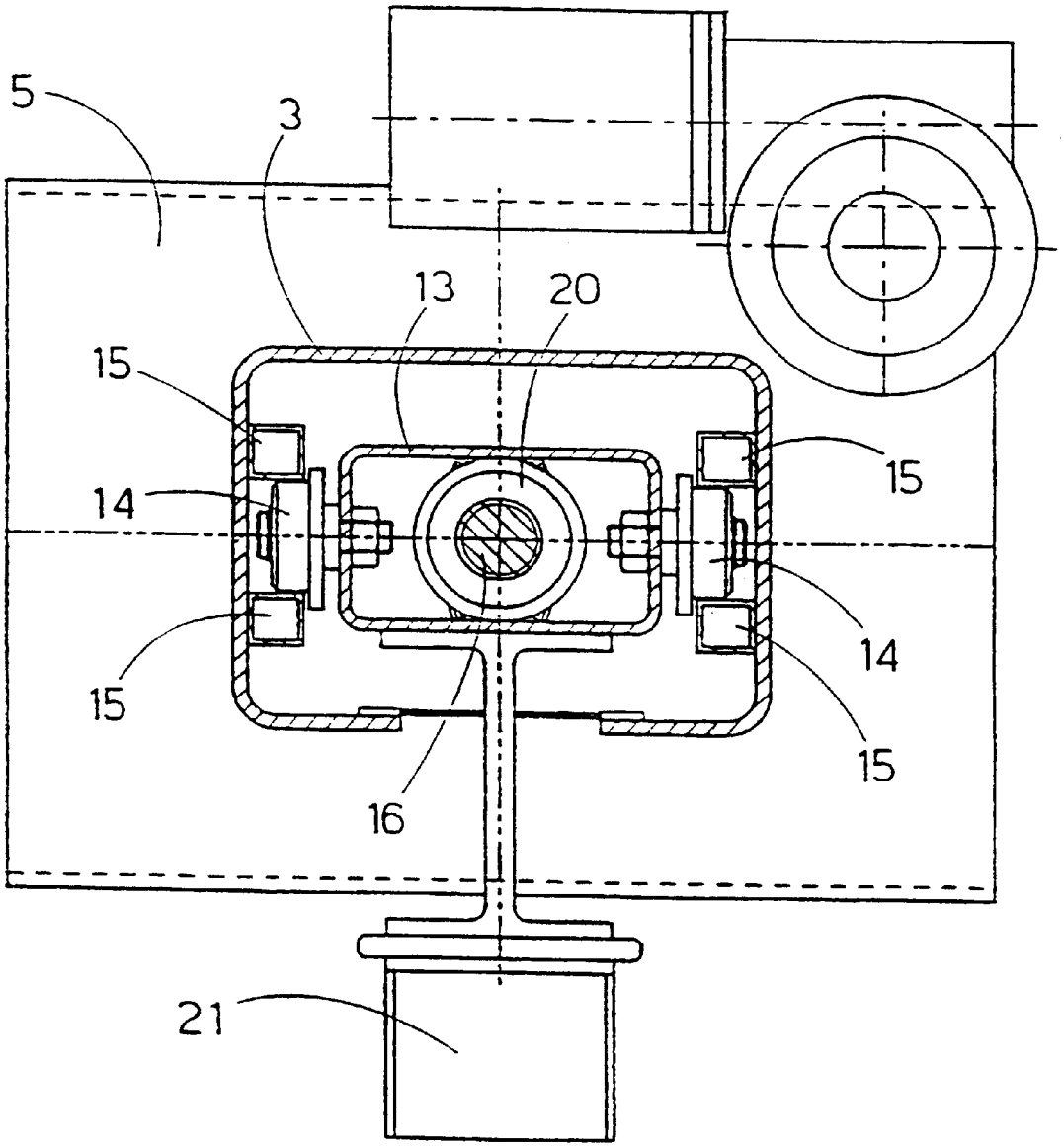
FIG. 6 is a schematic plan view of a detail of the apparatus of FIG. 1.
Figure 7:
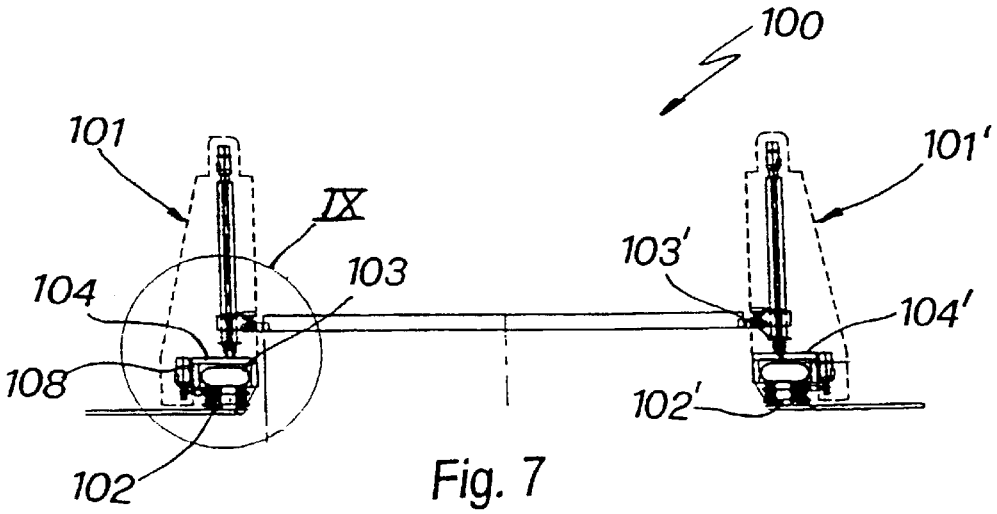
FIG. 7 is a schematic frontal view of a second embodiment of the apparatus according to the invention.
Figure 8:
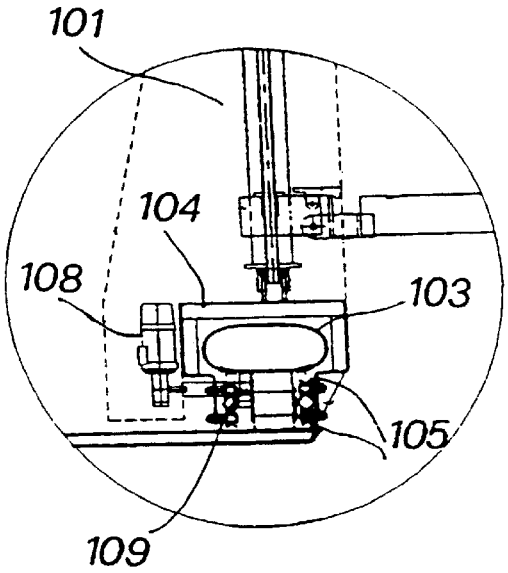
FIG. 8 is a schematic frontal view of a detail of the apparatus of FIG. 7 in enlarged scale.
Figure 9:
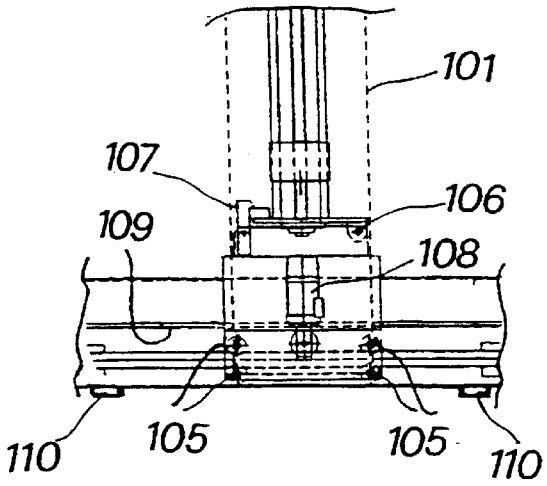
FIG. 9 is a schematic lateral view of the detail of FIG. 8.
Figure 10:
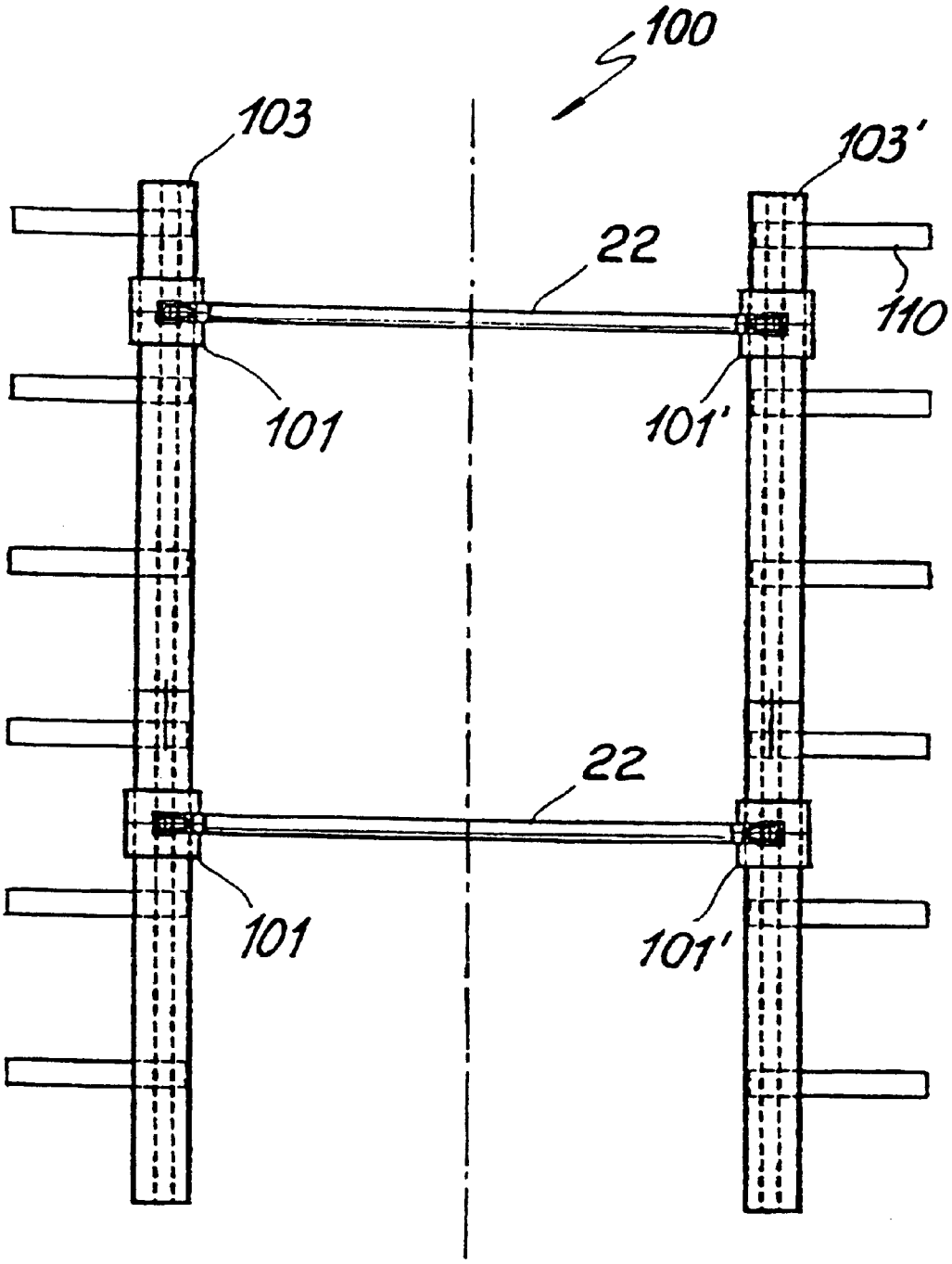
FIG. 10 is a schematic plan view of the apparatus of FIG. 7.
Figure 11:
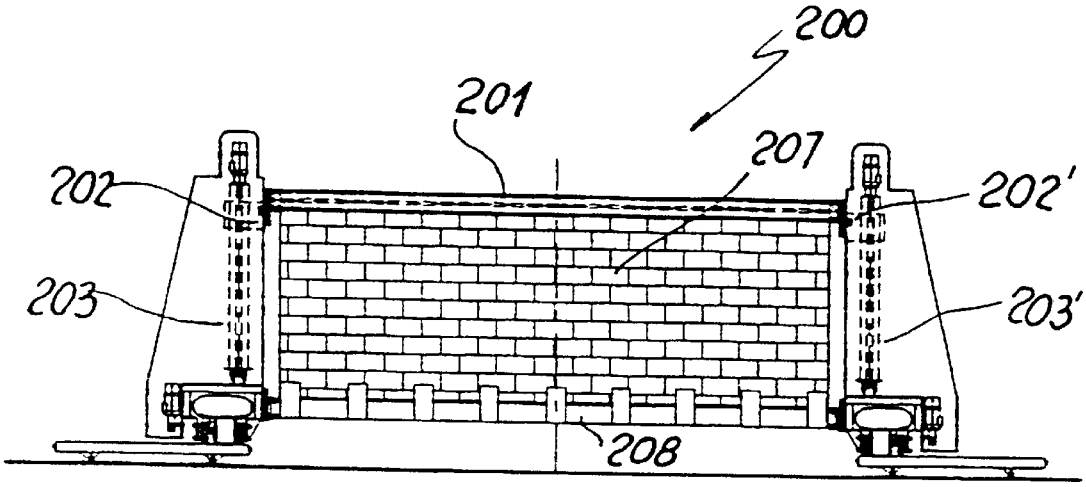
FIG. 11 is a schematic frontal view of a first auxiliary device of the apparatus according to the invention in a first operating phase.
Figure 12:
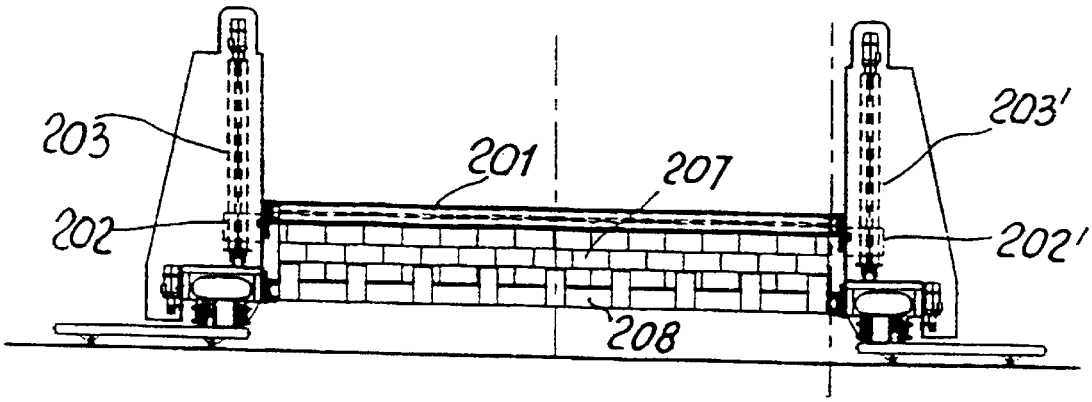
FIG. 12 is a schematic frontal view of a first auxiliary device of the apparatus according to the invention in a second operating phase.
Figure 15:
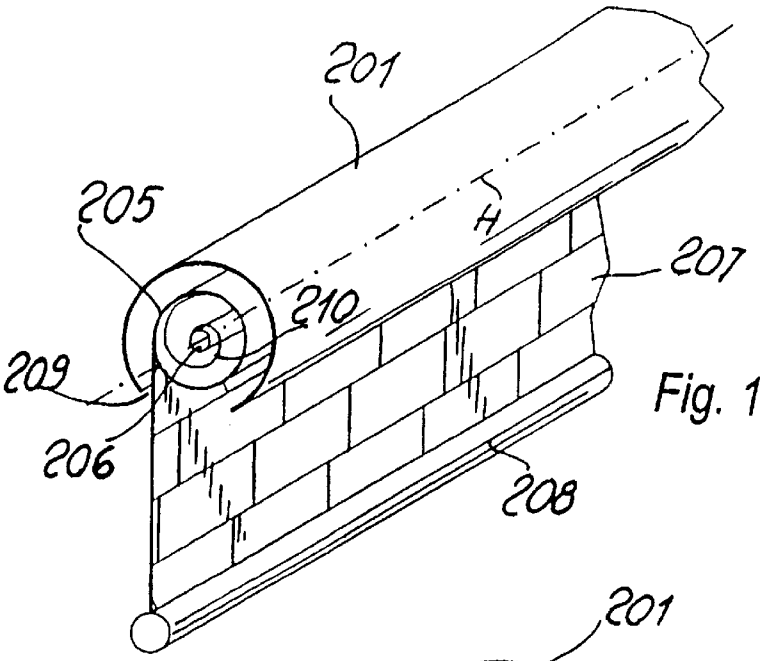
FIG. 15 is an elevation view of the detail of FIG. 14.
Figure 14:
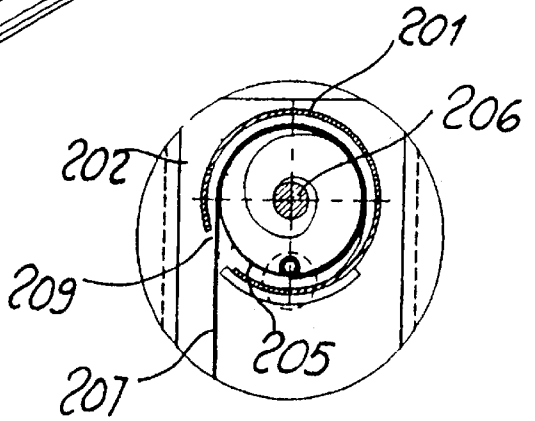
FIG. 14 is a schematic lateral view of a detail of FIG. 13 in enlarged scale.
Figure 13:
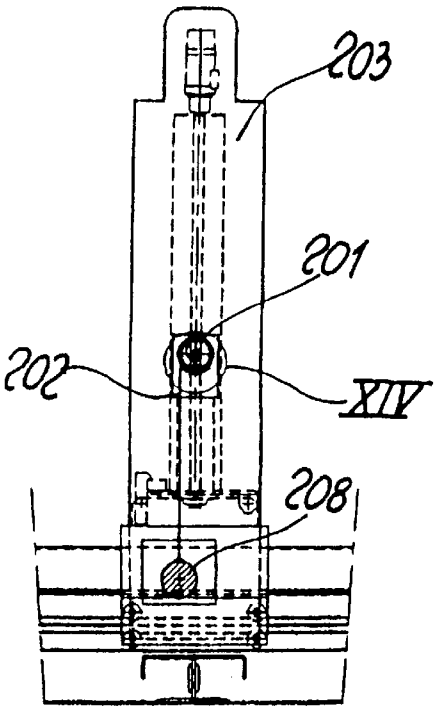
FIG. 13 is a schematic lateral view of a first auxiliary device of the apparatus according to the invention in a first operating phase.

As it is seen in detail in the FIGS. 1 and 2, each carriage is constituted by a shaped plate 5 comprising two pairs of lower idle rollers 6 with a horizontal axis which face one another at the inside of the plate 5 in which they are attached, in a manner to remain contained therein.

The above-described wheels 6 are inserted inside pairs of horizontal profiled elements 7 positioned at the sides of the rail 2, in a manner such that each carriage remains coupled to the rail with the possibility to slide thereon.

The above-described carriage is motorised, that is it may slide on the rails 2 by mean of the actuation of a reduction motor 8 with a horizontal axis fixed to a transmission unit 9 positioned on the plate 5, and therefore kinematically connected to an internal shaft 10 whose pinion, which meshes with a rack 12 fixed on the lower external edge of the rail 2, determines the movement of the carriage relative to the rail itself.

The above-described vertical elements 3 and 3' positionable and adjustable on the rails 2, comprise a mobile and vertically adjustable device, which constitutes an element for the support and the holding of the crosspiece constituting the obstacle, as well as an element for the vertical adjustment of the crosspiece itself.

Said device is constituted by a slider 13, along whose vertical edges are applied two pairs of wheels 14 which give to the slider itself the possibility to slide along the vertical guides 15, positioned at the inside of the due columns A and B making part of each mobile vertical element 3.

In correspondence with its own central part, each slider comprises a pulling unit 20 in which there is present a vertical threaded through hole, crossed by a worm screw 16, the latter disposed vertically and below a bearing 17 positioned on the upper end of the element 3. The screw 16 may be subjected to axial rotation supplied by a kinematic unit 18 actuated by a reduction motor 19.

On the external part of each slider 13 there is finally fixed a bracket 21 for the support of the crosspieces 22 constituting the obstacles, which bracket will be obviously turned towards the internal side of the apparatus and exactly in front of the bracket 21 of the other slider forming part of the support unit with which it is coupled.

It is provided that, in correspondence with each bracket 21, there is installed a device for holding the crosspieces 22, for example constituted by a spring device or by another flexible element, which allows to adjust the holding force of the obstacle (from zero to the maximum tightness), and to avoid its falling conforming to the intensity of the knockings caused by the horse.

From what is described, the operation of the present apparatus for training horses is therefore intuitable, whose crosspieces 22, positioned between facing support pairs, may be adjusted vertically by means of the synchronised displacement of the brackets 21 and horizontally along the rails 2.

Naturally, for the correct operation and the synchronisation of the pairs of supports, all of the motors are connected to a command and control central unit, for example of the microprocessor type, which establishes, in accordance with the imposed commands, the position of each crosspiece with respect to the others.

For this purpose all of the motors or only some of them may intervene in accordance with the various adjustment requirements.

The movement of the obstacles may be imposed either from the command panel present in correspondence with said control central unit, or by a telecommand actuatable at a distance and comprising a suitable keyboard which allows to act on the movement of the single crosspieces. The telecommand may be connected, by means of radio frequency or other more suitable frequency, to the control central unit.

This apparatus offers the possibility to render the sequence of the strides of the horse more or less difficult and demanding, raising all the crosspieces together or only some of them or still staggering the regularity of their interdistance, and possibly mixing the measure of the heights and of the interdistances one may obtain the most suitable exercise for the various types of horse and their correct gymnastics.

Advantageously, it is also provided that in substitution of the mechanism for the movement of the sliders 13 there may be adopted others having the same function, for example represented by systems with toothed belts and return pulleys or by mechanisms with racks or other more suitable ones.

In the same manner, in substitution of the rack mechanisms and of their actuation means for the adjustment and horizontal movement of the carriages 4 of said vertical elements or mounts, there may be utilised other similar ones having the same function.

The motors and the control instrumentation are powered preferably by low tension batteries which remain contained inside protective elements. Said batteries may be of the rechargeable type also by means of the use of solar panels.

The use of security systems and mechanisms is foreseen, which avoid non-regular movements and which block the motors in case of the absence of the crosspieces, as well as unblocking devices of the motors which allow the manual raising and movement of the barriers for example in case of the absence of the electrical current.

The use of control sensors may be provided along the rails, as well as the use of other sensors, controllers or encoders of various types, which allow to control the position of each mobile unit.

A further measure is constituted by the possibility to apply the entire apparatus on hidable raisable wheels, which render the movement of the apparatus itself and its positioning in the most suitable place easy and simple.

The second embodiment of the apparatus shown in FIGS. 7 to 10, generally indicated with the reference numeral 100, is distinguished over the first one shown in FIGS. 1 to 7 for a number of structural and functional features.

In particular, the apparatus 100 comprises vertical mounts 101, 101' slidable along respective modular lengths of rail 102, 102' which may be hingedly coupled to each other to allow gathering thereof in a limited space.

Tubular covers 103, 103' are fixed upon rails 102, 102', and have a substantially elliptical transverse cross section extending on both sides of the rail axis to protect the horses under training against sharp edges present on the rails.

Moreover, tubular covers 103, 103' protect the metallic parts of the rails against water, mud and in general against atmospheric agents, to thereby increase the life of the apparatus and reduce the maintenance thereof.

Carriages 104, 104' comprise frames formed by bent plates adapted to provide a substantially T-shaped transverse cross section to snugly house the tubular covers 103, 103'. Each carriage 104, 104' is provided with pairs of opposite wheels 105, 105' some of which are adjustable and resiliently supported.

Each vertical mount 101, 101' is attached to a respective carriage 104, 104' by means of a rotating joint having a substantially horizontal axis 106, 106' and is held in a vertical position by stop means 107, 107' that can be automatically released to allow the overturning of the mount upon high energy impacts.

Carriages 104, 104' are coupled to motor reduction units 108, 108' each of which has a pinion meshing with a rack 109, 109' that is attached to the rails 102, 102' in a position that is protected by covers 103, 103'.

The pinion of each motor reduction unit 108, 108' can be disengaged from the rack by a clutch or a similar device not visible in the drawings, to allow the free sliding of carriages 104, 104' along the rails in case of failure of the motor means and to quickly gather all the mounts of the apparatus on a length of rail.

The lengths of rail 102, 102' are laid down on the ground with the interposition of adjustable feet 110 to compensate slight unevenness of the field.

The above described preferred embodiments of the apparatus may be associated with a series of auxiliary devices adapted to change the basic configuration of the apparatus and to permit particular exercises both in training and competitions.

A first auxiliary device is constituted by an obstacle with a variable geometry, depicted in FIGS. 11 to 14 and generally indicated with the reference numeral 200, which device is essentially constituted by a tubular elements 201 similar to a normal crosspiece supported by a pair of vertically mobile supports 202, 202' which are translatable along respective vertical guides 203, 203' fixed on mounts 204, 204'.

A cylinder 205 is housed within the tubular element 201 and is supported at the opposite ends by pins 206 attached to the tubular element 201 so as to rotate on its longitudinal axis H co-axially of the tubular elements 201.

A length 207 of fabric or plastic sheet on which is reproduced the image of a virtual obstacle, such as for example a wall of tiles or fence, is wound on cylinder 205.

A transverse crosspiece 208 is attached to the lower edge of the length of fabric 207 and is anchored to a fixed part of the vertical mounts 204, 204' of the obstacle. The tubular element 201 has a longitudinal slit 209 for the passage of the length of fabric 207. One or more springs 210 of a spiral configuration act on cylinder 205 to resiliently wind and unwind the length of fabric 207 upon vertical movement of the tubular elements 201.

In use, when the vertically mobile supports 202, 202' are raised or lowered, the length of fabric 207 is retained in correspondence of its lower edge and is wound or unwound so as to change the total height of the obstacle and adjust the visual impact on the horse to be trained.

As an alternative, cylinder 205 may be rotated by a motor, not shown in the drawings, so as to adjust the size of the length of fabric 207 released from the tubular element 201 to correspondingly change the visual impact even with the tubular element 201 completely raised.

A further auxiliary device is provided by an obstacle with two or more crossed crosspieces wherein the crossing angle β of the ground may be changed, the device being generally indicated with the reference numeral 300 and is shown in FIGS. 16 to 23.

The auxiliary device 300 comprises special brackets, in particular upper brackets 301, 301' and lower brackets 302, 302' which may be anchored to the vertically mobile supports 303, 303' sliding along mounts 304, 304'.

Brackets 301, 301', 302, 302' may be connected to supports 303, 303' with the interposition of vertical connecting plates 305, 305' provided with holes for supporting crosspieces 306, 306' at various heights and with the interposition of a horizontal connecting plate 307, 307' provided with holes for supporting pairs of adjacent and/or inclined crosspieces 306.

Brackets 301, 301', 302, 302' allow crosspieces to be supported with any cross angle β to thereby automatically adjust the distance between the contact points of the crosspiece on the vertically mobile supports according to their inclination angle, so as to hold the crosspiece firmly in position, and reduce vibration caused by impacts imposed by the horses.

Figure 18:
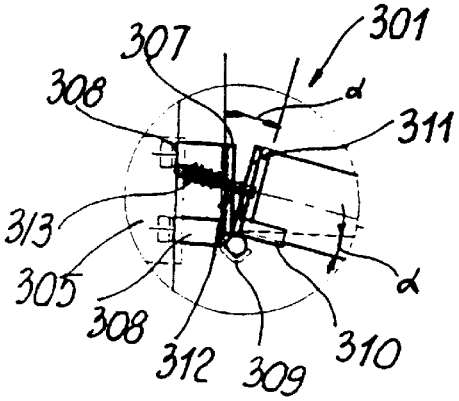
FIG. 18 is a schematic frontal view in enlarged scale of a detail of FIG. 16.
Figure 20:
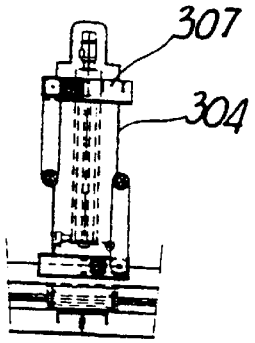
FIG. 20 is a schematic lateral view of the auxiliary device of FIG. 16.

In particular, each of the brackets 301, as shown in FIG. 18 in enlarged scale, is formed by the horizontal connecting plate 307 anchored to the vertical plate 305 by means of bolts 308.

At the lower edge 309 of the connecting plate 307 there is hinged a substantially L-shaped member formed by a curved supporting plate 310 adapted to support an end portion of crosspiece 306 to which a substantially perpendicular end plate 311 is attached.

A screw 312 is connected to end plate 311 with the interposition of a compression spring 313 to resiliently adjust the inclination angle α formed by the supporting plate 310 with respect to the connecting plate 307, which is half of the cross angle β between crosspieces 306.

Figure 19:
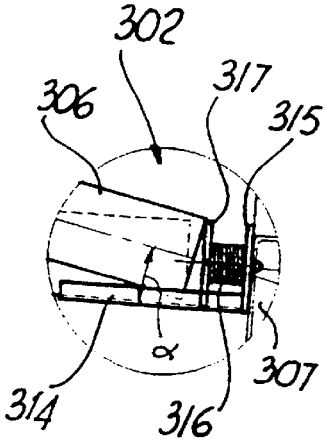
FIG. 19 is a schematic frontal view in enlarged scale of another detail of FIG. 16.

Similarly, each of the lower brackets 302, 302', one of which is shown in enlarged scale in FIG. 19, is constituted by a substantially L-shaped member formed by a curved lower plate 314 attached to a substantially perpendicular end fixed plate 315.

One of the ends of crosspiece 306 is supported by a corresponding curved lower plate 314 and is urged against the opposite end by a compression spring 316 with the interposition of an abutment washer 317 that is slidable along plate 319.

Figure 21:
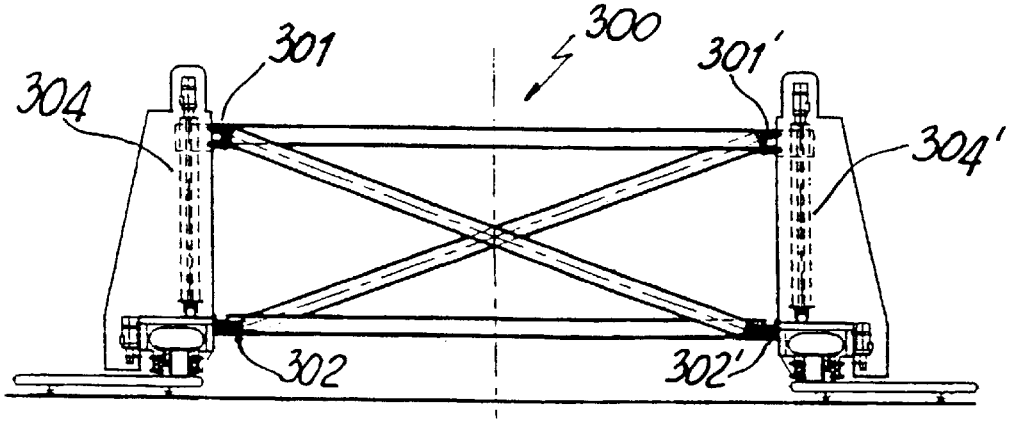
FIG. 21 is a schematic frontal view of the auxiliary device of FIG. 16 in a further operating phase
Figure 22:
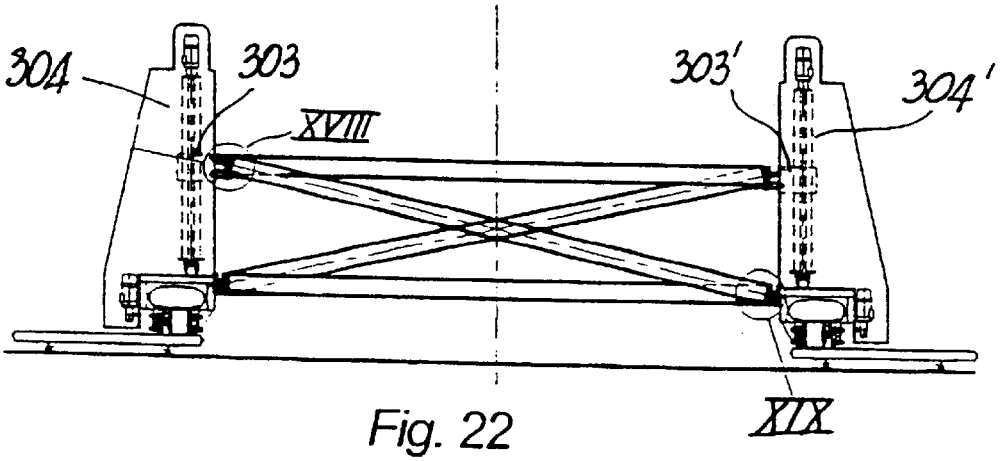
FIG. 22 is a schematic frontal view of the auxiliary device of FIG. 16 in another operating phase.
Figure 23:
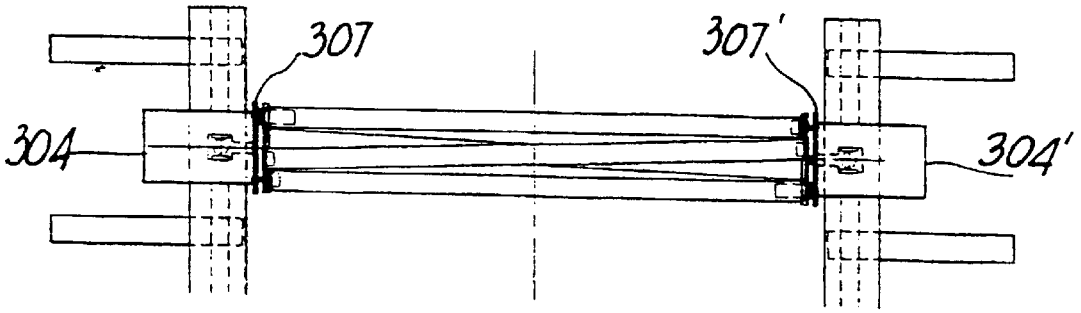
FIG. 23 is a schematic plan view of the auxiliary device of FIG. 16.

In order to adjust the inclination angle α of each crosspiece, it is sufficient to fix the lower bracket 302 at a given height to a stationary part of the device, for example to a carriage, leaving the upper bracket 301 free to slide along the vertical mount as shown in FIGS. 21, 22.

Figure 16:
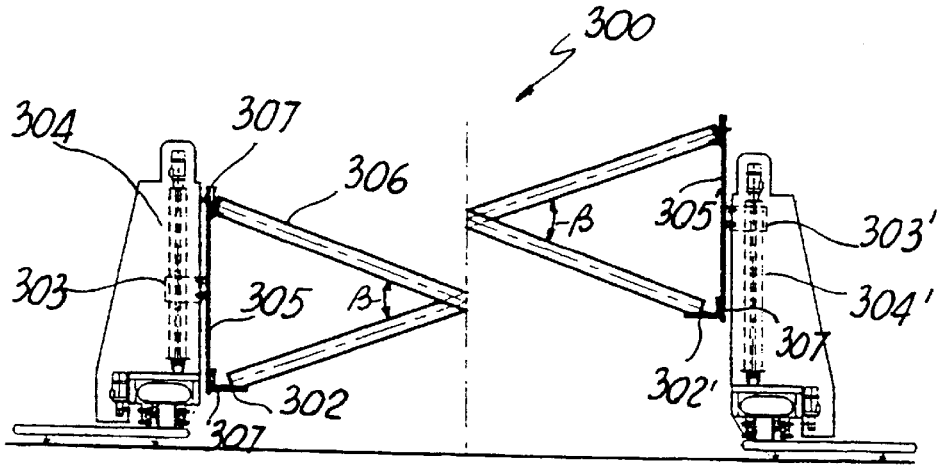
FIG. 16 is a schematic frontal view of a second auxiliary device of the apparatus according to the invention in a first operating phase.
Figure 17:
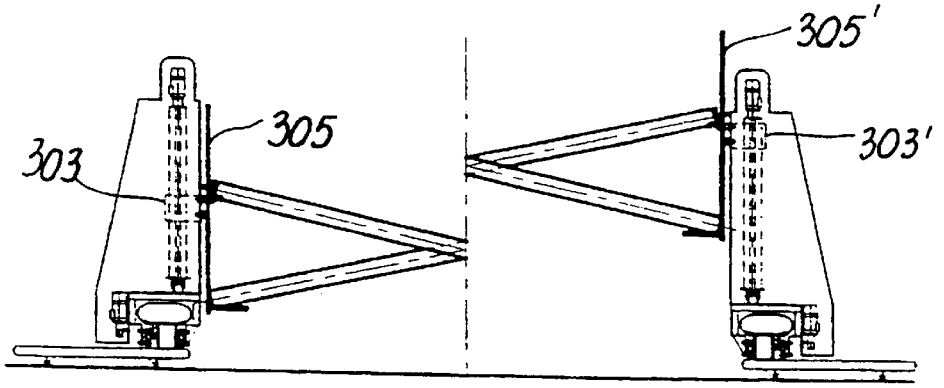
FIG. 17 is a schematic frontal view of a second auxiliary device of the apparatus according to the invention in a second operating phase.

In order to move one or more crosspieces, leaving substantially unchanged the crossing β angle therebetween, it is sufficient to fix the lower and upper brackets to respectively vertical and horizontal connecting plates 305, 307 which are caused to move with the vertical mount as shown in FIGS. 16, 17.

Figure 24:
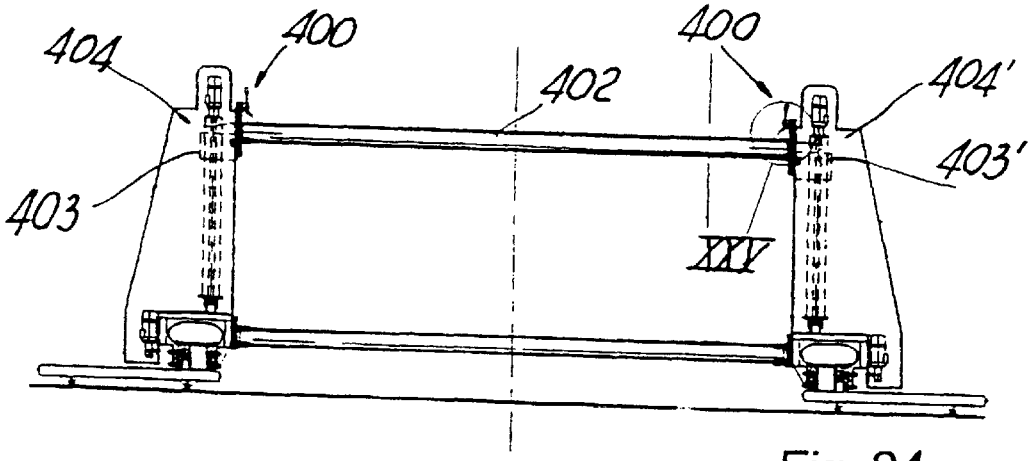
FIG. 24 is a schematic frontal view of a third auxiliary device for the apparatus according to the invention.
Figure 25:
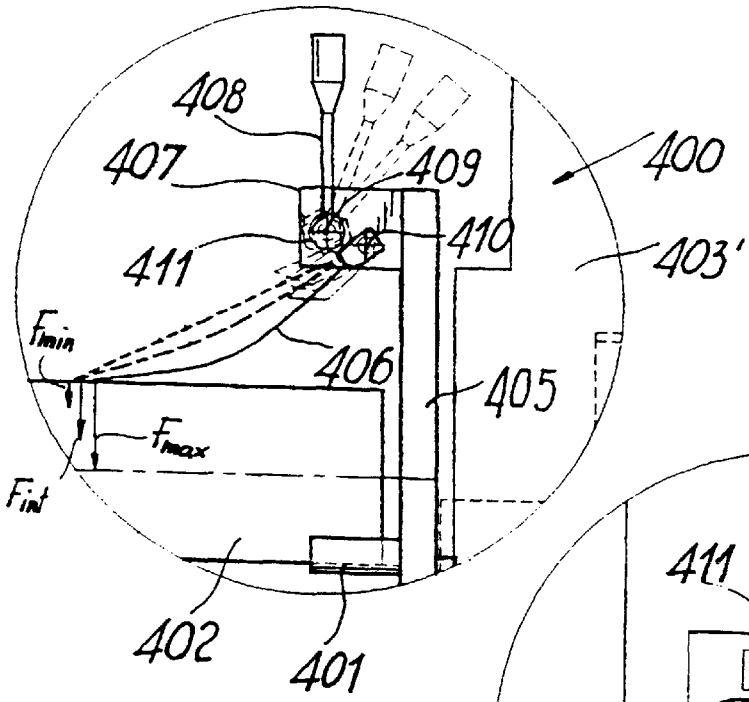
FIG. 25 is a schematic frontal view in enlarged scale of a detail of the auxiliary device of FIG. 24.
Figure 26:
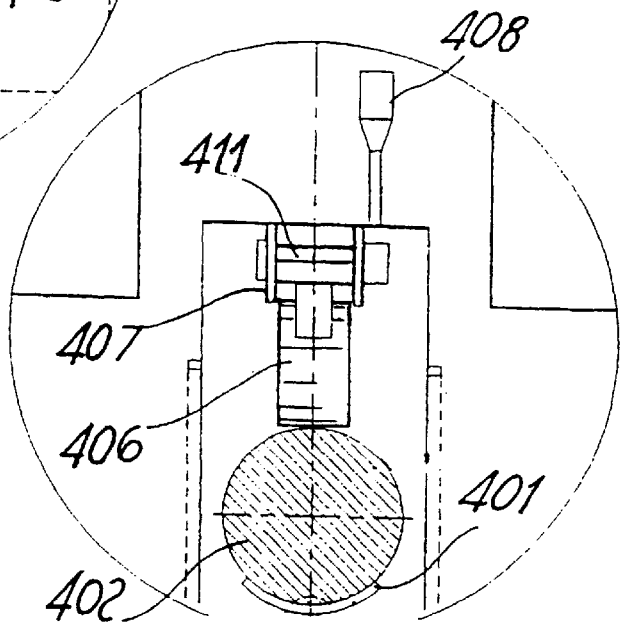
FIG. 26 is a schematic frontal view in enlarged scale of another detail of the auxiliary device of FIG. 24.

A further auxiliary device, generally indicated with the reference numeral 400 illustrated in FIGS. 24 to 26, essentially consists in an elastic stop means adapted to maintain a crosspiece in its initial position even in case of impact of remarkable entity.

The auxiliary device 400 comprises a special bracket essentially formed by curved supporting plates 401, 401' adapted to support the ends of the horizontal crosspiece 402 and attached to vertically mobile supports 403, 403' sliding along vertical mounts 404, 404' with the interposition of a connecting plate 405.

A leaf spring 406 is attached to connecting plate 405 to urge an end of crosspiece 402 against bracket 401 with a pre-load F of predetermined amount. Spring 406 has one end hinged to a forked support 407 that is attached to the connecting plate 405. In order to adjust the value of the pre-load, it is possible to act on spring 406 varying the deformation thereof.

To this end, a handle 408 is pivoted on the forked support 407 about the pivot axis 409 that is spaced apart from the axis of the pin 410. Handle 408 has on its pivot axis 409 a quadrangular or polygonal formation 411 eccentric with respect to the pivot axis 409 so as to provide faces at different distances from such rotation axis.

When the handle 408 is in its vertical position, as depicted with continuous line in FIG. 25, spring 406 undergoes its maximum deformation and exerts its maximum reaction force or pre-load on crosspiece 402. Upon rotation of handle 408 in one of the positions drawn with phantom line in FIG. 25, the deformation of spring 406 is reduced varying correspondingly the reaction force acting on crosspiece 402.

Thanks to such device, it is possible to reduce the number of repositioning of crosspieces in case of impact of relatively low energy, so as to reduce the need of frequent interventions of workers, to improve the concentration of horses during the training session and moreover to force the horses to have more consideration of obstacles with higher resistance to fall.

Figure 27:
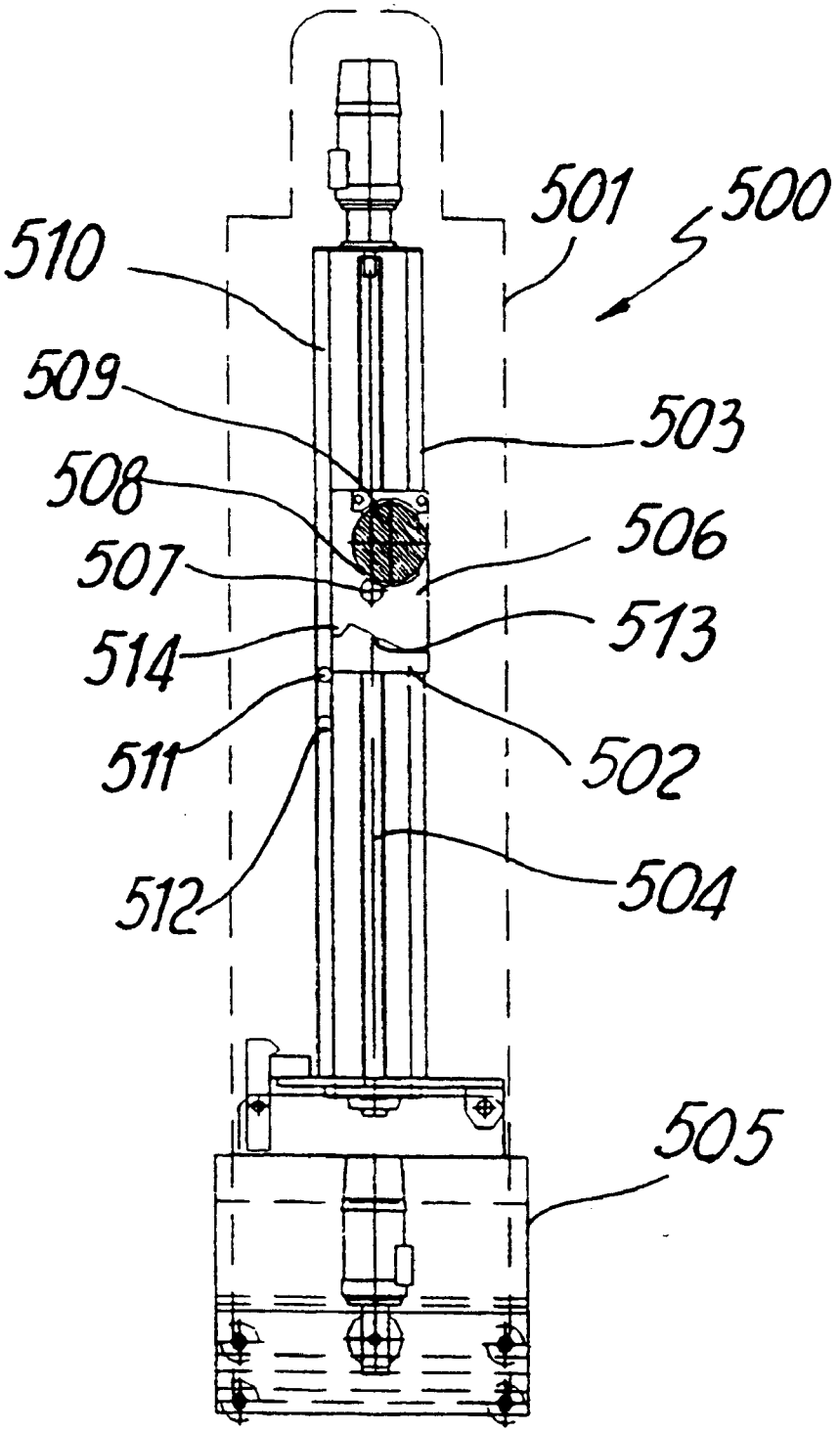
FIG. 27 is a schematic lateral view of a fourth auxiliary device for the apparatus according to the invention.

In case of impact of higher energy, the elastic stop means 400 described above may be insufficient to keep the crosspieces in its initial position. In order to obviate to this drawback, the stop means 400 is used in combination with an automatic positioning device shown in FIGS. 27 and 28 and generally indicated with 500.

Such device 500 allows the brackets supporting a crosspiece to rotate about a substantially horizontal axis as a consequence of an impact of relatively high energy and afterward to bring the same crosspieces back to its initial position, without any manual intervention.

The automatic positioning device 500 is associated to each vertical mount 501 and comprises a vertically mobile support 502 which is guided along a first vertical rod 503. Support 502 is driven by a worm screw 504 which is mounted on carriage 505 attached to the lower end of mount 501.

A vertical plate 506 is hinged to the vertically mobile support 502 to rotate about a substantially horizontal transverse axis 507 by about 180° in both directions.

A curved plate 508 for supporting one end of a crosspiece 509 substantially parallel to axis 507 is fixed to the vertical plate 506 in eccentric position with respect to rotation axis 507.

A second vertical rod 510 is fixed to carriage 505 near to the vertically mobile support 502 and carries a pair of pins or projections 511, 512 spaced from each other in vertical direction.

At the opposite end of bracket 508 with respect to the rotation axis 507, plate 506 is provided with a ramp formation 513 and with an indentation 514 which is adapted to co-operate with pins 511, 512 upon upward movement of support 502.

Finally, support 502 is provided with position means not depicted in the drawings, particularly with microswitches for detecting the end angular positions of plate 506 and with releasable detent means of the sphere-and-spring type to keep plate 506 in its end angular positions.

FIGS. 28*a* to 28*f* show several phases of the operating mode of the automatic positioning devices 500.

Figure 28A:
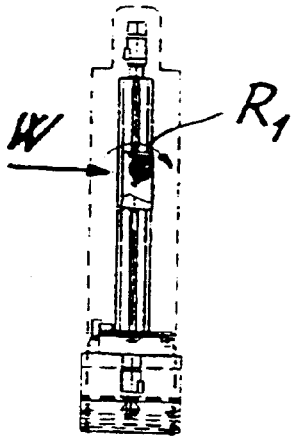
FIG. 28*a*) to FIG. 28*f*) are schematic lateral views of the device of FIG. 27 in subsequent operating phases.
Figure 28B:
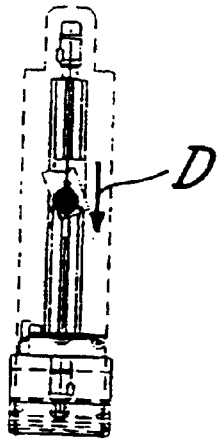

In FIG. 28*a* the device is shown in its initial phase with the crosspiece 509 located in its upper position. When crosspiece 509 is subject to an impulsive force W, plate 506 is caused to rotate in clockwise direction R1 activating a first microswitch mounted on support 502.

The electric signal generated by the microswitch is directed to a control unit controlling the driving motor of worm screw 504 to thereby promote translation of support 502 and bracket 508 in a downward direction D.

Once the support 502 has reached the lower position of its vertical stroke, a second microswitch generates an electric signal that is directed to the control unit to invert the rotation of worm screw 504, thereby causing the upward movement of support 502 in upward direction U.

Figure 28C:
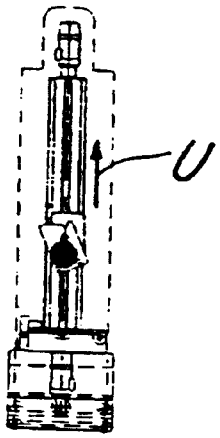
Figure 28D:
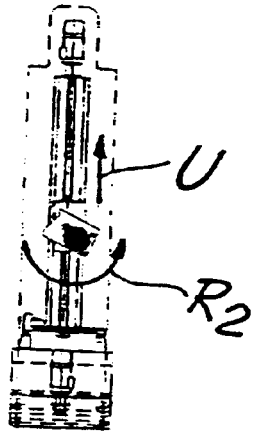
Figure 28E:
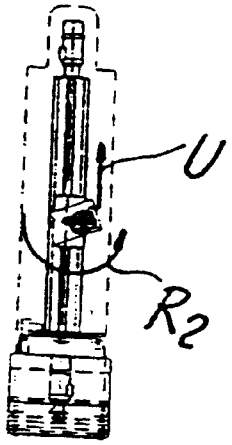
Figure 28F:
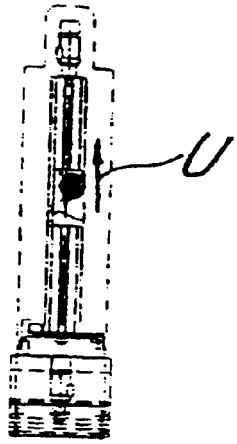

To start from the position of FIG. 28*c*, the ramp formation 513 and the indentation 514 interfere with pins 511, 512 thus automatically rotating a support 502 in a anticlockwise direction R2 to vertically align it as shown in FIG. 28*c*.

When support 502 reaches in its vertical aligned position, it is raised towards the upper end position shown in FIG. 28*a*.

The present adjustable spaced barrier apparatus has been described and illustrated according to a preferential solution, but there may be provided some variations, technically equivalent to the cited mechanical parts and components, which are therefore considered comprised in the scope of protection of the present invention set forth in the attached claims.

This application claims priority of the Italian patent application No. VR97000054 filed on Jun. 18, 1997.

What is claimed is:

1. An apparatus for training horses, comprising a series of adjustable obstacles including transverse crosspieces to be jumped over by the horses to be trained, a plurality of vertical elements or mounts having vertically mobile supports for supporting and holding the crosspieces of said obstacle at adjustable height, characterised by the fact of comprising a base structure formed by a pair of substantially horizontal and parallel guide rails disposed on the ground at a predetermined distance from each other, the vertical elements or mounts being slidably placed upon said guide rails to adjust their longitudinal position therealong.

2. An apparatus according to claim 1, characterised by the fact that the same number of vertical elements or mounts is disposed on both rails in mutually facing relationship with respect to each other to form pairs of mounts placed along orthogonal directions with respect to the axes of the rails.

3. An apparatus according to claim 1, characterised by the fact that each of said vertical mounts is fixed on a carriage adapted to slide along said guide rails.

4. An apparatus according to claim 3, characterised by the fact that each of said carriages are wheeled carriages and comprise first motor means adapted to provide synchronous horizontal movement of each pair of mounts along said rails, said first motor means comprising a pinion meshing with a rack fixed along one edge of each rail or a similar driving mechanism.

* * * * *